US011372358B1

(12) United States Patent
Kojima

(10) Patent No.: US 11,372,358 B1
(45) Date of Patent: Jun. 28, 2022

(54) IMAGE FORMING APPARATUS

(71) Applicant: TOSHIBA TEC KABUSHIKI KAISHA, Tokyo (JP)

(72) Inventor: Takahiro Kojima, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/400,846

(22) Filed: Aug. 12, 2021

(51) Int. Cl.
*G03G 15/00* (2006.01)
*G03G 15/04* (2006.01)

(52) U.S. Cl.
CPC ..... *G03G 15/5062* (2013.01); *G03G 15/0409* (2013.01); *G03G 15/04036* (2013.01); *G03G 15/5045* (2013.01); *G03G 15/5058* (2013.01)

(58) Field of Classification Search
CPC ..... G03G 15/04036; G03G 15/0409; G03G 15/5045; G03G 15/5058; G03G 15/5062
See application file for complete search history.

(56) References Cited

U.S. PATENT DOCUMENTS

2007/0268358 A1 11/2007 Noguchi et al.
2016/0274521 A1* 9/2016 Iwata ..... G03G 15/043
2017/0299976 A1 10/2017 Mizutani et al.
2018/0143559 A1* 5/2018 Omura ..... G03G 15/04072
2020/0021708 A1 1/2020 Kojima et al.

FOREIGN PATENT DOCUMENTS

JP 2009-128628 A 6/2009

* cited by examiner

*Primary Examiner* — Hoang X Ngo
(74) *Attorney, Agent, or Firm* — Foley & Lardner LLP

(57) ABSTRACT

An image forming apparatus includes a processor. The processor is configured to emit a laser beam reflected by a polygon mirror, the polygon mirror rotated by a polygon motor, form an image based on a latent image carried on a photoconductor by the laser beam, store an execution frequency of an image quality self-check of the image formed and a rotation duration of the polygon motor during a standby operation period of image formation, accept a change in the execution frequency, change the rotation duration based on the change in the execution frequency, execute the image quality self-check based on the execution frequency, and continuously rotate the polygon motor during the standby operation period based on the rotation duration stored.

20 Claims, 11 Drawing Sheets

IMAGE FORMING APPARATUS

FIELD

Embodiments described herein relate generally to an image forming apparatus.

BACKGROUND

An image forming apparatus includes an exposure device, and the exposure device includes a polygon mirror and a polygon motor. At the time of printing, the polygon motor that rotates the polygon mirror generates heat, and the temperature rises inside the housing of the exposure device. The temperature rise causes the housing to expand, and the expansion may change the positions or angles of the lens and mirror inside the housing, resulting in exposure misalignment. Exposure misalignment causes color misalignment. In order to prevent this, correction control (color registration) of exposure misalignment is performed.

DETAILED DESCRIPTION

Certain image forming apparatuses such as those described above may be configured to form a patch for measuring misalignment on a transfer belt according to a correction control, measure the position of the patch, detect the amount of misalignment between an ideal position and the measured position of the patch, and change an exposure timing based on the amount of misalignment to correct the exposure misalignment.

Further, the image forming apparatus may detect the temperature in the exposure device by a thermistor or the like provided in the exposure device, and execute correction control based on the comparison between the detected temperature and a temperature threshold. Alternatively, the image forming apparatus may execute correction control according to the elapsed time from previous correction control. Further, the image forming apparatus may accept a change in the temperature threshold or the elapsed time from a user and change the frequency of correction control.

In general, according to at least one embodiment, an image forming apparatus includes an optical scanning device, an image forming unit (e.g., an image forming device), a memory, an interface, and a processor. The optical scanning device emits a laser beam reflected by a polygon mirror rotated by a polygon motor. The image forming unit forms an image based on a latent image carried on a photoconductor by the laser beam emitted from the optical scanning device. The memory stores the execution frequency of an image quality self-check of the image formed by the image forming unit and the rotation duration of the polygon motor during a standby operation period of image formation. The interface accepts a change in the execution frequency. The processor changes the rotation duration based on the change in the execution frequency, executes the image quality self-check based on the execution frequency stored in the memory, and continuously rotates the polygon motor during the standby operation period based on the rotation duration stored in the memory. Hereinafter, the image forming apparatus according to at least one embodiment will be described with reference to drawings. In each drawing used for the description of the following embodiment, the scale of each unit is appropriately changed. In addition, the drawings used in the following embodiment are omitted as appropriate for the sake of description.

Configuration

Figure 1:
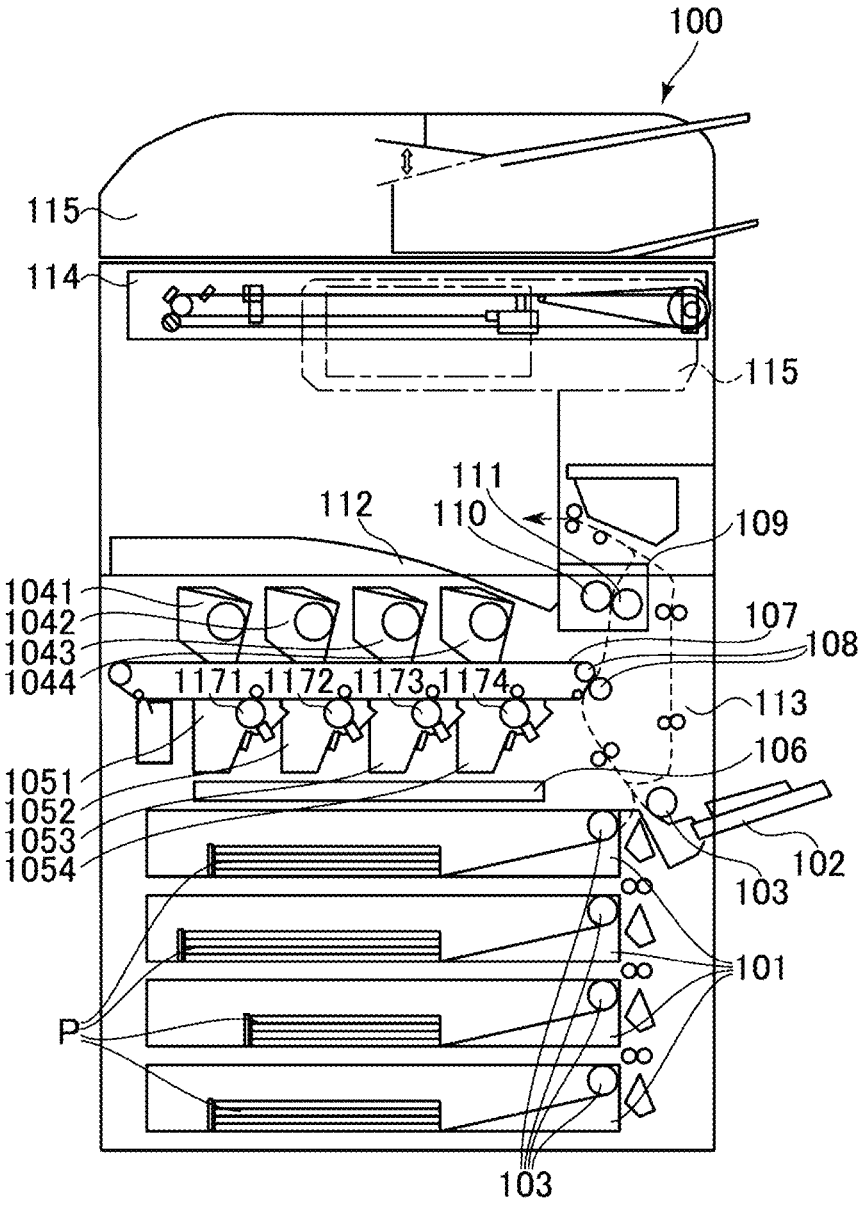
FIG. 1 illustrates a cross-sectional view of an example of an image forming apparatus according to at least one embodiment.

FIG. 1 is a cross-sectional view illustrating an example of the image forming apparatus 100 according to at least one embodiment. The image forming apparatus 100 will be described with reference to FIG. 1.

The image forming apparatus 100 prints an image by an electrophotographic method. The image forming apparatus 100 is, for example, a multi-function peripheral (MFP), a copier, a printer, a facsimile, or the like. As an example, the image forming apparatus 100 includes a paper feed tray 101, a manual feed tray 102, a paper feed roller 103, a toner cartridge 104, an image forming unit 105 (e.g., an image forming device), a transfer belt 107, a transfer roller 108, a fixing unit 109 (e.g., a fixing device), a heating unit 110 (e.g., a heater), a pressurizing roller 111, a paper discharge tray 112, a double-sided unit 113 (e.g., a double-sided device), a scanning unit 114 (e.g., a scanner), a document feeder 115, and a control panel 116.

The image forming unit 105 prints an image by an electrophotographic method. That is, the image forming unit 105 forms an image on an image forming medium P or the like by using a toner. The image forming medium P is, for example, a sheet of paper. The scanning unit 114 reads an image from a document. For example, the image forming apparatus 100 realizes a document copy by printing an image read from a document or the like by using the scanning unit 114 on the image forming medium P by using the image forming unit 105.

The paper feed tray 101 accommodates the image forming medium P used for printing.

The manual feed tray 102 is a table for manually feeding the image forming medium P.

The paper feed roller 103 rotates by the action of the motor to carry out the image forming medium P accommodated in the paper feed tray 101 or the manual feed tray 102 from the paper feed tray 101.

The toner cartridge 104 stores a toner to be supplied to the image forming unit 105. The image forming apparatus 100 includes a plurality of toner cartridges 104. As an example, the image forming apparatus 100 includes four toner cartridges 104 including a toner cartridge 1041, a toner cartridge 1042, a toner cartridge 1043, and a toner cartridge 1044. The toner cartridge 1041, the toner cartridge 1042, the toner cartridge 1043, and the toner cartridge 1044 store toner corresponding to respective colors of CMYK (cyan, magenta, yellow, and key (black)). The colors of the toner stored in the toner cartridge 104 are not limited to colors of CMYK, and may be any other colors. Further, the toner stored in the toner cartridge 104 may be special toner. For example, the toner cartridge 104 may store decolorizable toner that is decolorized at a temperature higher than a predetermined temperature and becomes invisible.

The image forming unit 105 includes a developer, a photoconductive drum 117, and the like. The developer develops an electrostatic latent image on the surface of the photoconductive drum 117 by using the toner supplied from the toner cartridge 104. As a result, a toner image is formed on the surface of the photoconductive drum 117. The image formed on the surface of the photoconductive drum 117 is transferred (e.g., primary transfer) onto the transfer belt 107. The image forming apparatus 100 includes a plurality of image forming units 105 (e.g., a plurality of image forming devices). As an example, the image forming apparatus 100 includes four image forming units 105 including an image forming unit 1051 (e.g., an image forming device), an image forming unit 1052 (e.g., an image forming device), an image forming unit 1053 (e.g., an image forming device), and an image forming unit 1054 (e.g., an image forming device), as illustrated in FIG. 1. The image forming unit 1051 including a photoconductive drum 1171, the image forming unit 1052 including a photoconductive drum 1172, the image forming unit 1053 including a photoconductive drum 1173, and the image forming unit 1054 including a photoconductive drum 1174 form images by receiving the toner supply corresponding to colors of CMYK, respectively.

Figure 2:
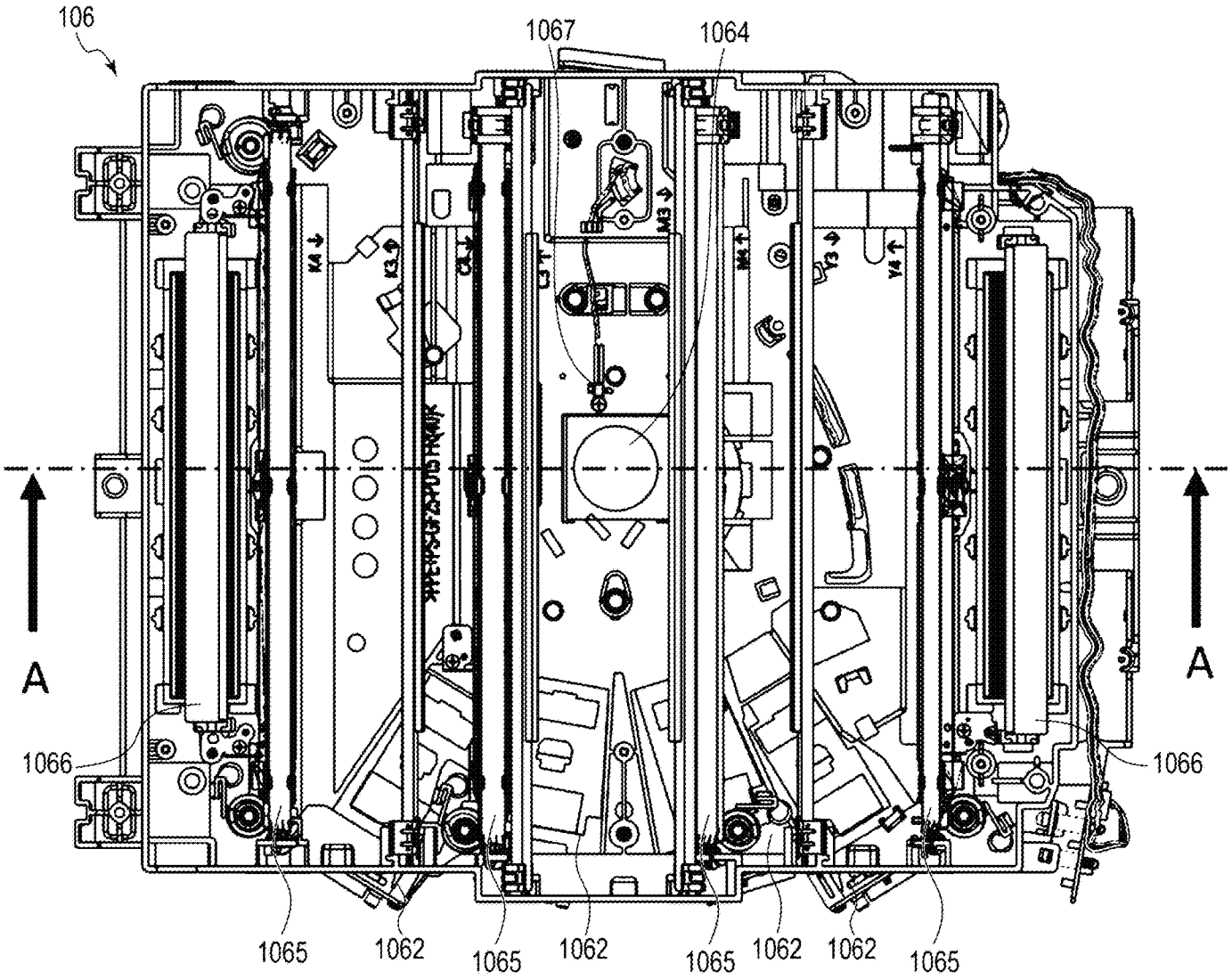
FIG. 2 illustrates a top view of an example of an optical scanning device according to at least one embodiment.
Figure 3:
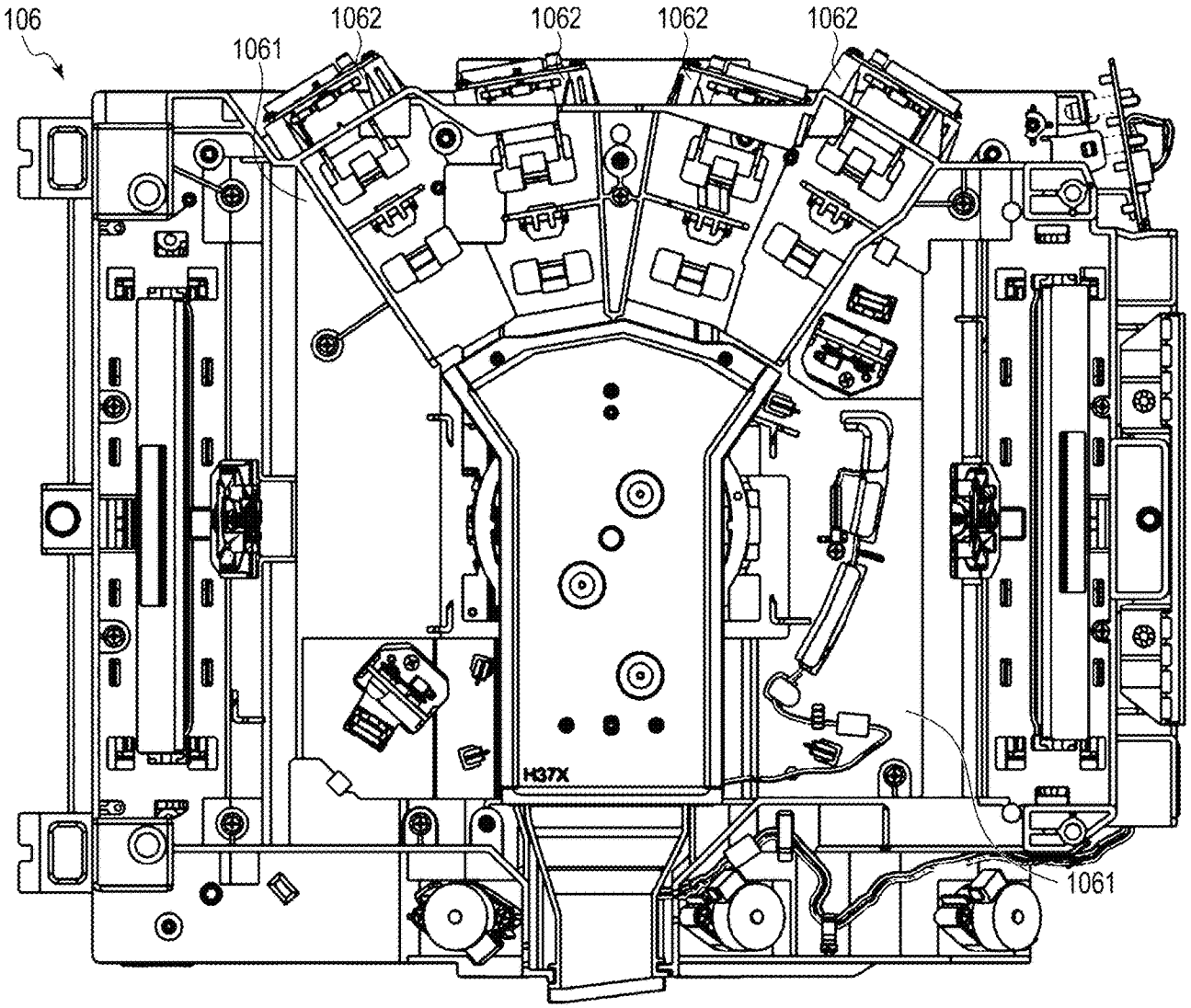
FIG. 3 illustrates a bottom view of an example of the optical scanning device.
Figure 4:
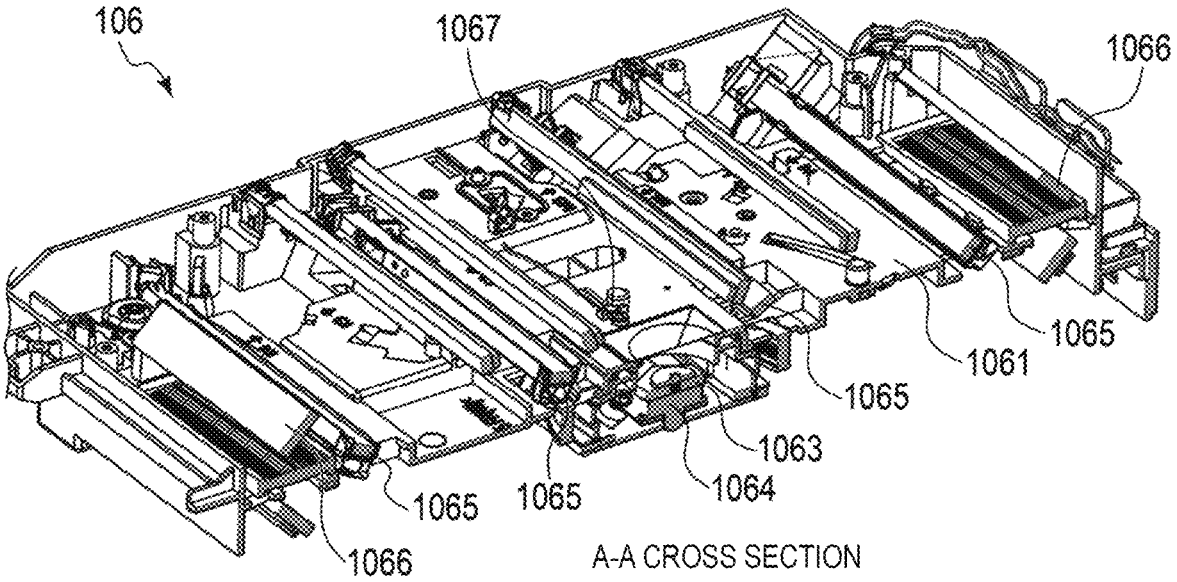
FIG. 4 illustrates a cross-sectional perspective view of an example of the optical scanning device.

An optical scanning device 106 will be described with reference to FIGS. 2 to 4. FIG. 2 illustrates a top view of an example of the optical scanning device 106 according to at least one embodiment. FIG. 3 illustrates a bottom view of an example of the optical scanning device 106 according to at least one embodiment. FIG. 4 illustrates a cross-sectional perspective view of an example of the optical scanning device 106 according to at least one embodiment. FIG. 4 illustrates a cross-sectional view taken along the line A-A illustrated in FIG. 2. The optical scanning device 106 is also called a laser scanning unit (LSU) (e.g., a laser scanner) or the like.

The optical scanning device 106 forms an electrostatic latent image on the surface of the photoconductive drum 117 of each image forming unit 105 by a laser beam controlled according to image data. As an example, the optical scanning device 106 includes a housing 1061, laser units 1062 (e.g., lasers), a polygon mirror 1063, a polygon motor 1064, mirrors 1065, lenses 1066, and a temperature sensor 1067.

In at least one embodiment, the correction control based on the elapsed time from the execution of the previous correction control of exposure misalignment or the correction control based on a temperature value (temperature change amount) detected by the temperature sensor 1067 will be described.

The housing 1061 supports the laser units 1062, the polygon mirror 1063, the polygon motor 1064, the mirrors 1065, the lenses 1066, and the temperature sensor 1067. The housing 1061 is made of, for example, resin.

As an example, the optical scanning device 106 includes a laser unit 1062C (e.g., a laser), a laser unit 1062M (e.g., a laser), a laser unit 1062Y (e.g., a laser), and a laser unit 1062K (e.g., a laser) corresponding to respective colors of CMYK. Each laser unit 1062 emits a laser beam. Each laser unit 1062 controls the emission of a laser beam according to a control signal corresponding to the image data. Further, each laser unit 1062 modulates the laser beam according to a control signal corresponding to the image data.

The polygon mirror 1063 reflects the laser beam emitted from each laser unit 1062. The polygon mirror 1063 is rotated by the polygon motor 1064 to perform polarized scanning of each laser beam. The polygon motor 1064 is a motor that rotates the polygon mirror 1063.

The heat generated by the polygon motor 1064 is a major factor in raising the temperature of the optical scanning device 106. Therefore, the polygon motor 1064 is an example of a heat source.

The mirror 1065 and the lens 1066 are optical elements for manipulating a laser beam.

The mirror 1065 is provided so that the position or angle with respect to the housing 1061 can be adjusted.

The temperature sensor 1067 detects the temperature inside the image forming apparatus 100. The temperature sensor 1067 outputs the measured temperature. The temperature sensor 1067 is, for example, a thermistor. As an example, the temperature sensor 1067 is installed in the vicinity of the polygon motor 1064 in the housing 1061 as illustrated in FIG. 2. The temperature sensor 1067 is an example of a temperature detection unit (e.g., a temperature detection device, a thermistor, etc.) that detects the temperature of a predetermined portion of the optical scanning device 106.

The flow returns to the description using FIG. 1.

The transfer belt 107 is, for example, an endless belt, and can be rotated by the action of a roller. The transfer belt 107 rotates to transport the image transferred from each image forming unit to the position of the transfer roller 108.

The transfer roller 108 includes two rollers facing each other. The transfer roller 108 transfers (secondary transfer) the image formed on the transfer belt 107 onto the image forming medium P passing between the transfer rollers 108.

The fixing unit 109 heats and pressurizes the image forming medium P on which the image is transferred. As a result, the transferred image on the image forming medium P is fixed. The fixing unit 109 includes a heating unit 110 (e.g., a heater) and a pressurizing roller 111 facing each other.

The heating unit 110 is, for example, a roller provided with a heat source for heating the heating unit 110. The heat source is, for example, a heater. The roller heated by the heat source heats the image forming medium P.

Alternatively, the heating unit 110 may include an endless belt suspended on a plurality of rollers. For example, the heating unit 110 includes a plate-shaped heat source, an endless belt, a belt transport roller, a tension roller, and a press roller. The endless belt is, for example, a film-like member. The belt transport roller drives the endless belt. The tension roller applies tension to the endless belt. An elastic layer is formed on the surface of the press roller. In the plate-shaped heat source, the heat generating portion side comes into contact with the inside of the endless belt and is pressed in the direction of the press roller to form a fixing nip having a predetermined width between the plate-shaped heat source and the press roller. Since the plate-shaped heat source heats while forming a nip region, the responsiveness at the time of energization is higher than that of the heating method using a halogen lamp.

The pressurizing roller 111 pressurizes the image forming medium P passing between the pressurizing roller 111 and the heating unit 110.

The paper discharge tray 112 is a table on which the printed image forming medium P is discharged.

The double-sided unit 113 brings the image forming medium P into a state in which printing on the back surface is possible. For example, the double-sided unit 113 reverses the front and back of the image forming medium P by switching back the image forming medium P by using a roller or the like.

The scanning unit 114 reads an image from a document. The scanning unit 114 corresponds to a scanner for reading an image from a document. The scanner is an optical reduction system including an imaging element such as a charge-coupled device (CCD) image sensor. Alternatively, the scanner is a contact image sensor (CIS) system including an image element such as a complementary metal-oxide-semiconductor (CMOS) image sensor. Alternatively, the scanner is another known system.

The document feeder 115 is also called, for example, an auto document feeder (ADF). The document feeder 115 transports the documents placed on the document tray one after another. The image of the transported document is read by the scanning unit 114. Further, the document feeder 115 may include a scanner for reading an image from the back surface of a document.

The control panel 116 includes buttons, a touch panel, and the like for the user of the image forming apparatus 100 to operate. The touch panel is, for example, a stack of a display such as a liquid crystal display or an organic EL display and a pointing device by a touch input. Therefore, the buttons and the touch panel function as input devices that accept operations by the user of the image forming apparatus 100. Further, the display included in the touch panel functions as a display device for notifying the user of the image forming apparatus 100 of various information.

Figure 5:
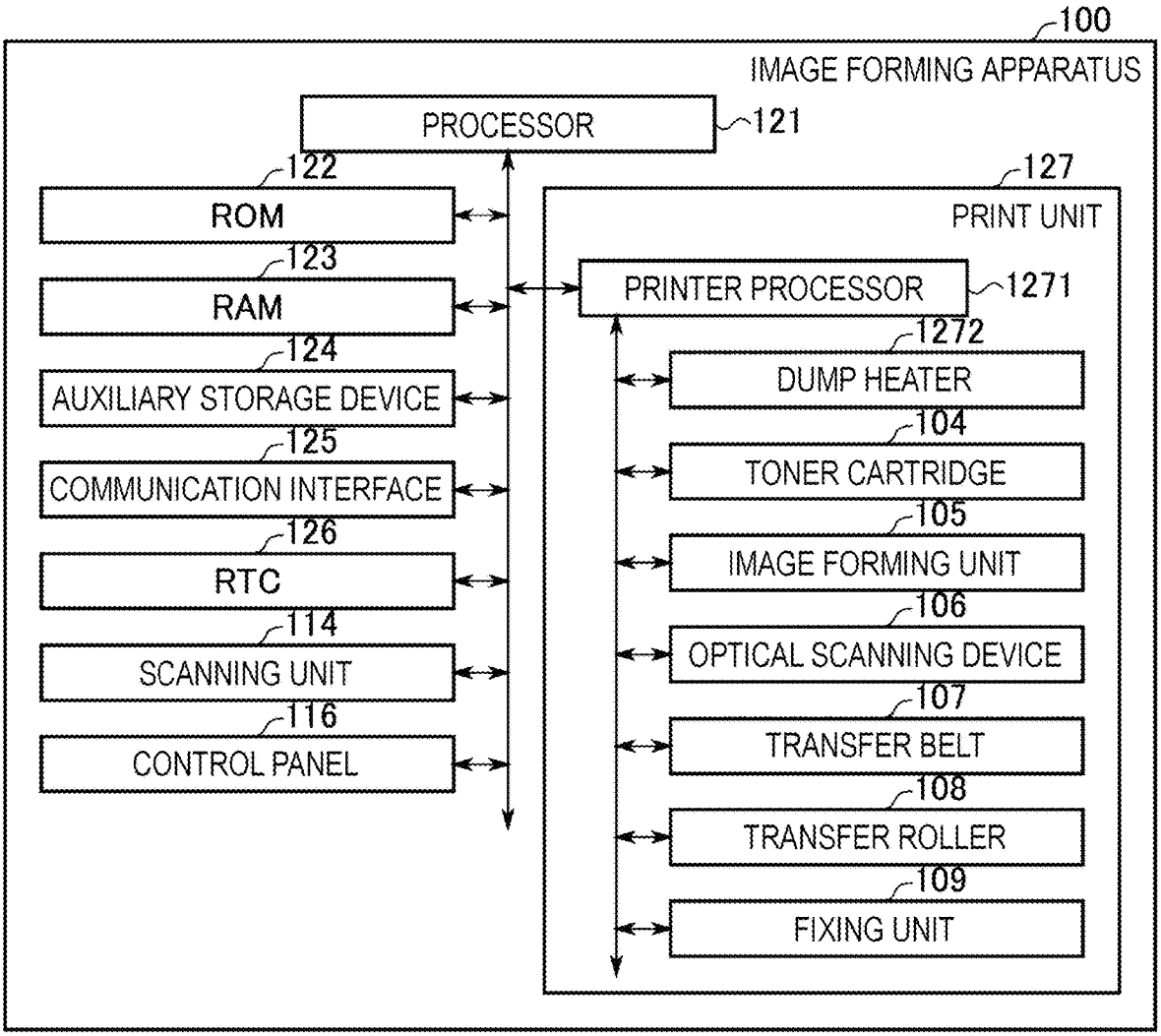
FIG. 5 illustrates a block view of an example of a circuit configuration of the image forming apparatus.

An example of the circuit configuration of the image forming apparatus 100 will be described with reference to FIG. 5. FIG. 5 illustrates a block view of an example of the circuit configuration of the image forming apparatus 100 according to at least one embodiment.

As an example, the image forming apparatus 100 includes a processor 121, a read-only memory (ROM) 122, a random-access memory (RAM) 123, an auxiliary storage device 124, a communication interface 125, a real-time clock (RTC) 126, the scanning unit 114, a print unit 127 (e.g., a printer), and the control panel 116.

The processor 121 corresponds to a central part of a computer that performs processing such as calculation and control necessary for the operation of the image forming apparatus 100. The processor 121 controls each part in order to realize various functions of the image forming apparatus 100 based on a program such as system software, application software, or firmware stored in the ROM 122 or the auxiliary storage device 124 or the like. The processor 121 includes, for example, a central processing unit (CPU) (e.g., a central processor), a micro processing unit (MPU) (e.g., a microprocessor), a system on a chip (SoC), a digital signal processor (DSP), a graphics processing unit (GPU) (e.g., a graphics processor), an application specific integrated circuit (ASIC), a programmable logic device (PLD), a field-programmable gate array (FPGA), or the like. Alternatively, the processor 121 is a combination of a plurality of these above.

The ROM 122 is a non-temporary computer-readable storage medium, and corresponds to the main storage device of a computer centered on the processor 121. The ROM 122 is a non-volatile memory used exclusively for reading data. The ROM 122 stores the above program. The ROM 122 also stores data or various setting values used by the processor 121 to perform various kinds of processing.

The RAM 123 corresponds to the main storage device of a computer centered on the processor 121. The RAM 123 is a memory used for reading and writing data. The RAM 123 is used as a so-called work area or the like for storing data temporarily used by the processor 121 for performing various kinds of processing.

The auxiliary storage device 124 is a non-temporary computer-readable storage medium, and corresponds to an auxiliary storage device of a computer centered on the processor 121. The auxiliary storage device 124 is, for example, an electric erasable programmable read-only memory (EEPROM) (registered trademark), a hard disk drive (HDD), a solid state drive (SSD), or the like. The auxiliary storage device 124 may store the above program. In addition, the auxiliary storage device 124 stores data used by the processor 121 to perform various processing, data generated by the processing of the processor 121, various setting values, and the like. The image forming apparatus 100 may include an interface capable of inserting a storage medium such as a removable optical disk, a memory card, or a universal serial bus (USB) memory in place of the auxiliary storage device 124 or in addition to the auxiliary storage device 124.

The program stored in the ROM 122 or the auxiliary storage device 124 includes a program for executing processing described later. As an example, the image forming apparatus 100 is transferred to an administrator of the image forming apparatus 100 in a state where the program is stored in the ROM 122 or the auxiliary storage device 124. However, the image forming apparatus 100 may be transferred to the administrator or the like in a state where the program is not stored in the ROM 122 or the auxiliary storage device 124. Further, the image forming apparatus 100 may be transferred to the administrator or the like in a state where a program different from the above-described program is stored in the ROM 122 or the auxiliary storage device 124. Then, the program for executing the processing described later may be separately transferred to the administrator or the like and written to the ROM 122 or the auxiliary storage device 124 under the operation of the administrator or a serviceman. The transfer of the program at this time can be realized, for example, by recording on a removable storage medium such as a magnetic disk, a magneto-optical disk, an optical disk, or a semiconductor memory, or by downloading via a network or the like.

The communication interface 125 is an interface for the image forming apparatus 100 to communicate via a network or the like.

The RTC 126 is a clock or a circuit having a built-in clock function.

A dump heater 1272 warms the inside of the image forming apparatus 100 in order to prevent dew condensation and the like. The dump heater 1272 operates, for example, if the dew condensation prevention function is turned on and the image forming apparatus 100 does not perform an operation such as printing for a certain period of time or longer.

The print unit 127 is a printer that prints an image on the image forming medium P or the like based on the image data. As an example, the print unit 127 includes a printer processor 1271, the dump heater 1272, the toner cartridge 104, the image forming unit 105, the optical scanning device 106, the transfer belt 107, the transfer roller 108, and the fixing unit 109.

The printer processor 1271 performs processing such as calculation and control necessary for the printing operation of the image forming apparatus 100 in order to realize the printing function. The printer processor 1271 performs processing such as calculation and control necessary for printing operations based on instructions and the like from the processor 121 and various programs. Further, the printer processor 1271 outputs a processing result or the like to the processor 121. The various programs may be stored in a storage unit (e.g., a memory) such as the ROM 122 or the auxiliary storage device 124, or may be incorporated in the circuit of the printer processor 1271. Alternatively, the storage unit provided in the print unit 127 may store various programs. The printer processor 1271 is, for example, a CPU, MPU, SoC, DSP, GPU, ASIC, PLD, or FPGA.

The dump heater 1272 warms the inside of the image forming apparatus 100 in order to prevent dew condensation and the like. The dump heater 1272 operates, for example, if the dew condensation prevention function is turned on and the image forming apparatus 100 does not perform an operation such as printing for a certain period of time or longer.

Operation

Figure 6:
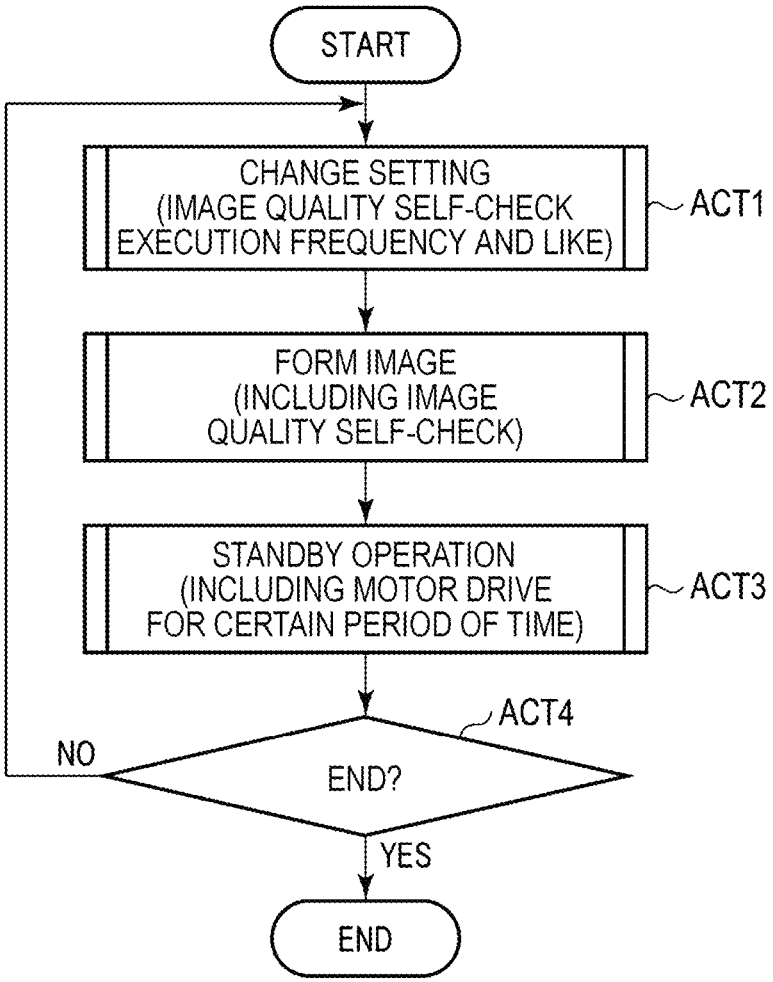
FIG. 6 illustrates a flowchart of an example of an overall operation of the image forming apparatus.

FIG. 6 illustrates a flowchart of an example of an overall operation by the image forming apparatus 100 according to at least one embodiment. Each operation illustrated in FIG. 6 will be described in detail with reference to the flowcharts illustrated in FIGS. 7 to 9.

With the power on, for example, the control panel 116 of the image forming apparatus 100 displays a main menu. If the user selects a setting change item included in the main menu to change the setting, the control panel 116 accepts this selection via the main menu, and the processor 121 switches the main menu to the setting menu. The control panel 116 displays the setting menu instead of the main menu. The control panel 116 accepts various setting changes including a change in the image quality self-check execution frequency described later via the setting menu (ACT 1). The auxiliary storage device 124 as a memory stores the setting change.

Further, if the user selects a print item included in the main menu, the control panel 116 accepts this selection via the main menu. The scanning unit 114 scans the document according to the acceptance of this selection, and the print unit 127 executes image formation based on the image data obtained by scanning of the scanning unit 114 (ACT 2). If the printer processor 1271 determines that the execution condition of the image quality self-check is satisfied in this image formation, the printer processor 1271 executes the image quality self-check.

Further, the printer processor 1271 executes a standby operation if it is determined that there is no subsequent image formation after the image formation is completed (ACT 3). The printer processor 1271 drives the polygon motor 1064 for a certain period of time during the standby operation period.

If the power is not turned off, the image forming apparatus 100 continues to operate (ACT 4, NO) and continues to operate ACT 1, 2, and 3. If the power is turned off, the image forming apparatus 100 ends the operation (ACT 4, YES).

Here, the image quality self-check by the image forming apparatus 100 will be described. For example, the image quality self-check is a check for image misalignment affected by a temperature change due to heat generation of the polygon motor 1064. The optical scanning device 106 described above emits the laser beam reflected by the polygon mirror 1063 rotated by the polygon motor 1064. The image forming unit 105 forms an image based on a latent image carried on the photoconductive drum 117 by the laser beam emitted from the optical scanning device 106. The polygon motor 1064 generates heat when driven, and the temperature inside the housing 1061 rises. The temperature rise causes the housing 1061 to expand, and the expansion may change the positions or angles of the lens 1066, the mirror 1065, and the like inside the housing 1061, resulting in exposure misalignment. Exposure misalignment causes color misalignment. In order to prevent this, the correction control of the exposure misalignment is performed. This correction control is included in one of the image quality self-checks executed by the image forming apparatus 100.

For example, the auxiliary storage device 124 as a memory stores the execution frequency of the image quality self-check of the image formed by the image forming unit 105 and the rotation duration of the polygon motor 1064 during the standby operation period of image formation in association with each other.

Figure 7:
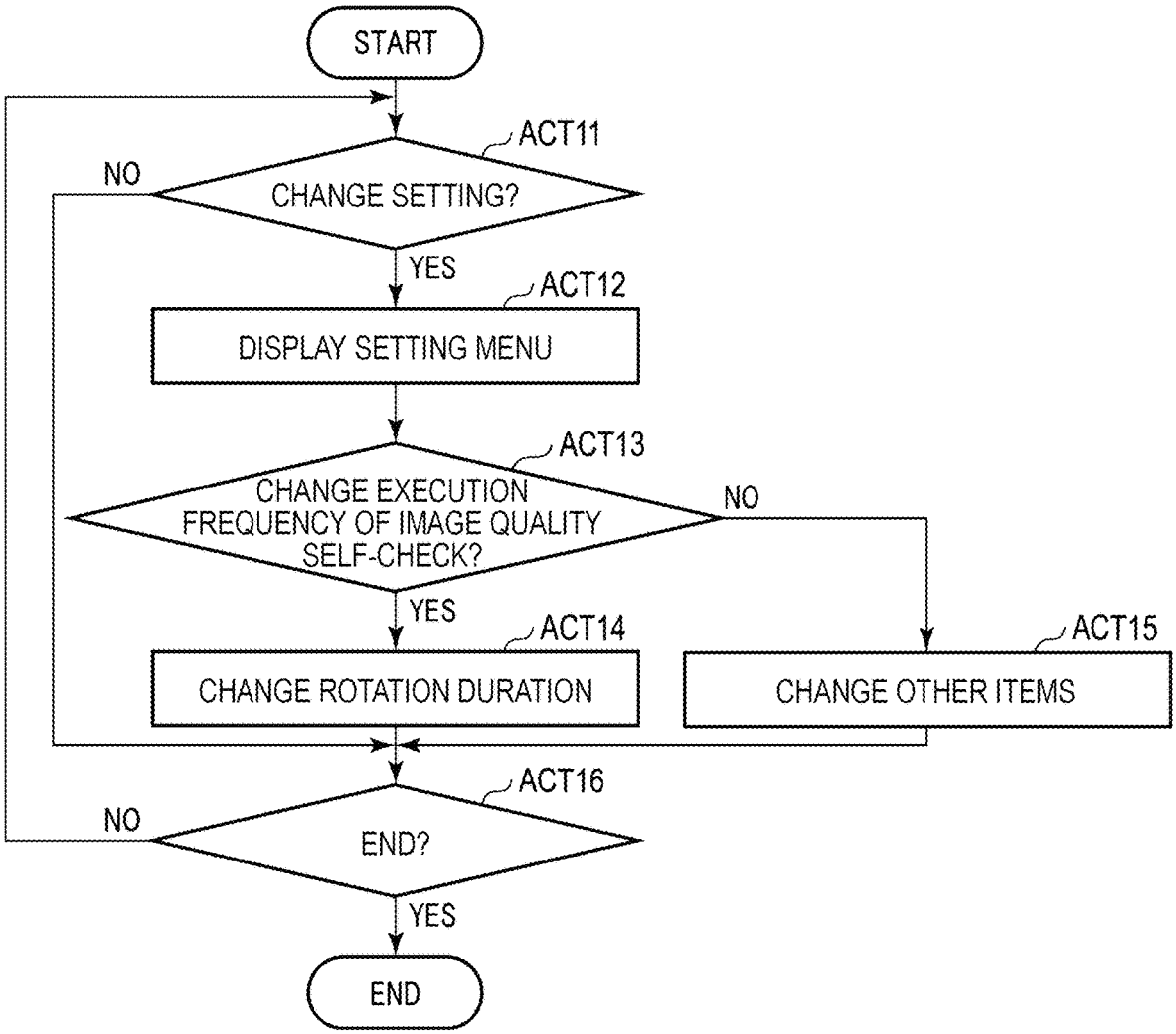
FIG. 7 illustrates a flowchart of an example of an operation related to setting change by the image forming apparatus.

FIG. 7 illustrates a flowchart of an example of the operation related to the setting change by the image forming apparatus 100 according to at least one embodiment. That is, FIG. 7 is a flowchart for describing in detail the setting change of ACT 1 illustrated in FIG. 6.

If the user selects a setting change item included in the main menu, the control panel 116 accepts this selection via the main menu (ACT 11, YES). The processor 121 switches the main menu to the setting menu according to the acceptance of this selection. The control panel 116 displays the setting menu instead of the main menu (ACT 12). The setting menu includes an image quality self-check item and other items. If the user selects the image quality self-check item, the control panel 116 accepts this selection. According to the acceptance of this selection, the processor 121 switches the setting menu to the menu for changing the execution frequency of the image quality self-check. The control panel 116 displays the menu for changing the execution frequency of the image quality self-check instead of the setting menu.

The menu for changing the execution frequency of the image quality self-check includes a plurality of execution frequency items having different execution intervals. For example, the change menu includes items such as "standard" (e.g., first execution frequency), "longer" (e.g., second execution frequency with a longer execution interval than the first execution frequency), "more longer" (e.g., third execution frequency with a longer execution interval than the second execution frequency), and "every time after printing" (e.g., fourth execution frequency). That is, the frequency decreases in the order of the first, second, and third execution frequencies. "Every time after printing" is an execution frequency that depends on the printing frequency. If the printing frequency is high, the image quality self-check is executed more frequently, and if the printing frequency is low, the image quality self-check is executed less frequently.

For example, the execution frequency is a frequency based on the elapsed time from the last execution of the image quality self-check. A first elapsed time, a second elapsed time longer than the first elapsed time, and a third elapsed time longer than the second elapsed time are defined. The execution condition based on the first execution frequency is a condition for executing the image quality self-check if the elapsed time from the last execution of the image quality self-check exceeds the first elapsed time and is less than the second elapsed time. The execution condition based on the second execution frequency is a condition for executing the image quality self-check if the elapsed time from the last execution of the image quality self-check exceeds the second elapsed time and is less than the third elapsed time. The execution condition based on the third execution frequency is a condition for executing the image quality self-check if the elapsed time from the last execution of the image quality self-check exceeds the third elapsed time. The auxiliary storage device 124 as a memory stores the execution conditions based on the first, second, and third execution frequencies and the execution condition (after printing) based on the fourth execution frequency.

Alternatively, the execution frequency is a frequency based on the acquisition interval of a temperature measurement value by the temperature sensor 1067. A first acquisition time, a second acquisition time longer than the first acquisition time, and a third acquisition time longer than the second acquisition time are defined. The execution condition based on the first execution frequency is a condition for acquiring the temperature measurement value by the temperature sensor 1067 at a first acquisition interval and comparing the acquired temperature measurement value with the temperature threshold to execute the image quality self-check if the acquired temperature measurement value exceeds the temperature threshold. The execution condition based on the second execution frequency is a condition for acquiring the temperature measurement value by the temperature sensor 1067 at a second acquisition interval and comparing the acquired temperature measurement value with the temperature threshold to execute the image quality self-check if the acquired temperature measurement value exceeds the temperature threshold. The execution condition based on the third execution frequency is a condition for acquiring the temperature measurement value by the temperature sensor 1067 at a third acquisition interval and comparing the acquired temperature measurement value with the temperature threshold to execute the image quality self-check if the acquired temperature measurement value exceeds the temperature threshold. The auxiliary storage device 124 as a memory stores the temperature threshold, and further stores the execution conditions based on the first, second, and third execution frequencies and the execution condition (after printing) based on the fourth execution frequency.

The auxiliary storage device 124 stores the execution frequency of the image quality self-check and the rotation duration of the polygon motor 1064 during the standby operation period of image formation in association with each other. For example, the auxiliary storage device 124 stores the first execution frequency and a first rotation duration in association with each other, the second execution frequency and a second rotation duration in association with each other, and the third execution frequency and a third rotation duration in association with each other, and the fourth execution frequency and a fourth rotation duration in association with each other. For example, the second rotation duration is shorter than the first rotation duration, and the third rotation duration is shorter than the second rotation duration. For example, the third rotation duration may be set to 0. That is, if the third rotation duration is applied, the polygon motor 1064 does not rotate. Further, the fourth rotation duration is any rotation duration. For example, the fourth rotation duration may be the longest rotation duration.

If the user selects a predetermined execution frequency included in the menu for changing the execution frequency of the image quality self-check, the control panel 116 accepts this selection via the change menu (ACT 13, YES). The processor 121 changes a current rotation duration to the rotation duration associated with the selected execution frequency, based on the table stored in auxiliary storage device 124 (ACT 14). For example, the processor 121 changes the currently set rotation duration to the first rotation duration if the first execution frequency is selected. Similarly, the processor 121 changes the currently set rotation duration to the second, third, or fourth rotation duration if the second, third, or fourth execution frequency is selected.

If the user selects other items included in the setting menu, the control panel 116 displays a change menu for other items (ACT 13, NO) and accepts other changes (ACT 15). Further, the image forming apparatus 100 continues the setting change if the change item is selected from the setting menu (ACT 16, NO), and ends the setting change if the end is selected from the setting menu (ACT 16, YES).

Figure 8:
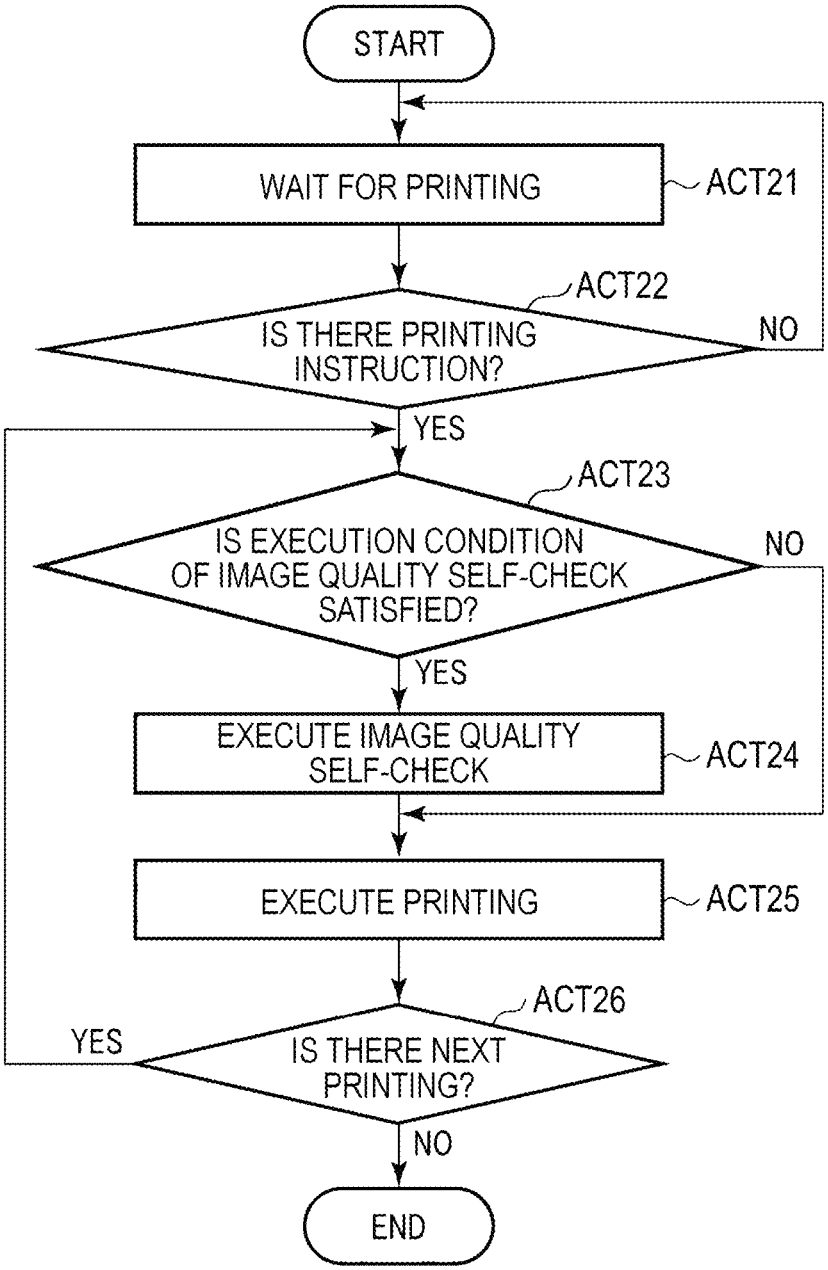
FIG. 8 illustrates a flowchart of an example of an operation related to image formation by the image forming apparatus.

FIG. 8 illustrates a flowchart of an example of an operation related to image formation by the image forming apparatus 100 according to at least one embodiment. That is, FIG. 8 is a flowchart for describing in detail the image formation of ACT 2 illustrated in FIG. 6.

The image forming apparatus 100 waits for an instruction such as printing from the user (ACT 21). If the user selects a printing item included in the main menu, the control panel 116 accepts this selection via the main menu. That is, the control panel 116 accepts a printing instruction (ACT 22, YES).

The printer processor 1271 determines whether or not the image quality self-check can be executed based on the execution condition of the image quality self-check stored in the auxiliary storage device 124. That is, the printer processor 1271 executes the image quality self-check if it is determined that the image quality self-check needs to be executed based on the execution frequency and the elapsed time.

For example, if the first execution frequency is selected, the printer processor 1271 detects the elapsed time since the last execution of the image quality self-check and determines whether or not the detected elapsed time exceeds the first elapsed time and is less than the second elapsed time. If the detected elapsed time exceeds the first elapsed time and is less than the second elapsed time, the execution condition of the image quality self-check is satisfied (ACT 23, YES), and the printer processor 1271 determines that the image quality self-check needs to be executed.

If the second execution frequency is selected, the printer processor 1271 detects the elapsed time since the last execution of the image quality self-check and determines whether or not the detected elapsed time exceeds the second elapsed time and is less than the third elapsed time. If the detected elapsed time exceeds the second elapsed time and is less than the third elapsed time, the execution condition of the image quality self-check is satisfied (ACT 23, YES), and the printer processor 1271 determines that the image quality self-check needs to be executed.

If the third execution frequency is selected, the printer processor 1271 detects the elapsed time since the last execution of the image quality self-check and determines whether or not the detected elapsed time exceeds the third elapsed time. If the detected elapsed time exceeds the third elapsed time, the execution condition of the image quality self-check is satisfied (ACT 23, YES), and the printer processor 1271 determines that the image quality self-check needs to be executed.

If the fourth execution frequency is set, the execution condition of the image quality self-check is satisfied after printing (ACT 23, YES), and the printer processor 1271 determines that an image quality self-check needs to be executed.

Alternatively, the printer processor 1271 causes the image quality self-check to be executed if it is determined that the image quality self-check needs to be executed based on the comparison between the temperature measurement value and the temperature threshold.

For example, if the first execution frequency is set, the printer processor 1271 acquires the temperature measurement value by the temperature sensor 1067 at the first acquisition interval and determines whether or not the temperature measurement value exceeds the temperature threshold. If the temperature measurement value exceeds the temperature threshold, the execution condition of the image quality self-check is satisfied (ACT 23, YES), and the printer processor 1271 determines that an image quality self-check needs to be executed.

If the second execution frequency is set, the printer processor 1271 acquires the temperature measurement value by the temperature sensor 1067 at the second acquisition interval and determines whether or not the temperature measurement value exceeds the temperature threshold. If the temperature measurement value exceeds the temperature threshold, the execution condition of the image quality self-check is satisfied (ACT 23, YES), and the printer processor 1271 determines that an image quality self-check needs to be executed.

If the third execution frequency is set, the printer processor 1271 acquires the temperature measurement value by the temperature sensor 1067 at the third acquisition interval and determines whether or not the temperature measurement value exceeds the temperature threshold. If the temperature measurement value exceeds the temperature threshold, the execution condition of the image quality self-check is satisfied (ACT 23, YES), and the printer processor 1271 determines that an image quality self-check needs to be executed.

If the fourth execution frequency is set, the printer processor 1271 acquires the temperature measurement value by the temperature sensor 1067 after printing and determines whether or not the temperature measurement value exceeds the temperature threshold. If the temperature measurement value exceeds the temperature threshold, the execution condition of the image quality self-check is satisfied (ACT 23, YES), and the printer processor 1271 determines that an image quality self-check needs to be executed.

If the execution condition of the image quality self-check is satisfied (ACT 23, YES), the printer processor 1271 instructs the execution of the image quality self-check and causes the image quality self-check to be executed. The image forming unit 105 executes the image quality self-check based on the execution instruction of the image quality self-check (ACT 24). That is, the image forming unit 105 forms a patch for measuring the misalignment of an image with a plurality of colors (CMYK) on the transfer belt 107 and measures the formed patch. Further, the image forming unit 105 detects misalignment between the ideal position and the measured patch, changes (e.g., corrects) the exposure timing based on the misalignment to correct the exposure misalignment of the image with the plurality of colors. Subsequently, the image forming unit 105 executes printing based on the printing instruction of ACT 22 (ACT 25).

If the execution condition of the image quality self-check is not satisfied (ACT 23, NO), the printer processor 1271 executes the print instruction of ACT 22 without instructing the execution of the image quality self-check. As a result, the image forming unit 105 executes printing based on the printing instruction of ACT 22 (ACT 25).

If the printer processor 1271 receives a next print instruction (ACT 26, YES), the processing after ACT 23 is continued. If the printer processor 1271 has not received the next print instruction (ACT 26, NO), the printer processor 1271 ends image formation (ACT 26).

Figure 9:
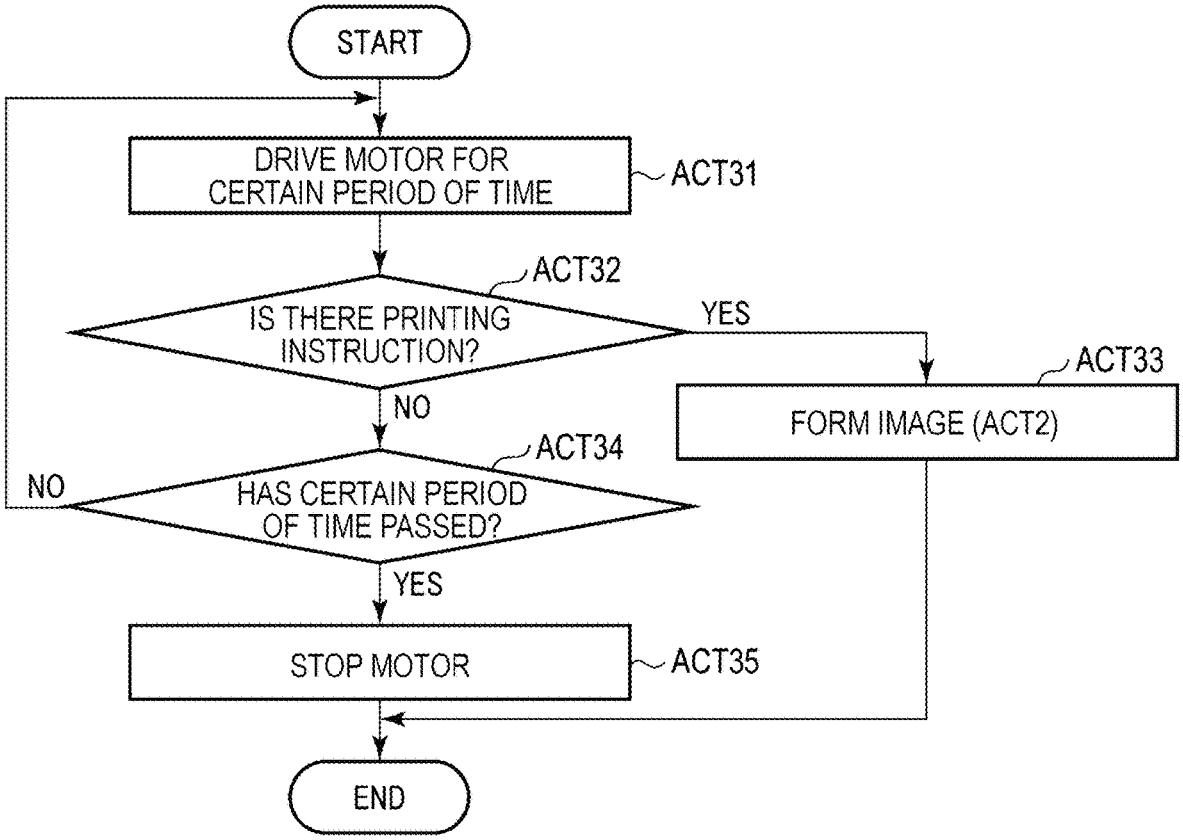
FIG. 9 illustrates a flowchart of an example of a standby operation by the image forming apparatus.

FIG. 9 illustrates a flowchart of an example of the standby operation by the image forming apparatus 100 according to at least one embodiment. That is, FIG. 9 is a flowchart for describing in detail the standby operation of ACT 3 illustrated in FIG. 6.

When determining that there is no subsequent print instruction after printing is completed, the printer processor 1271 executes the standby operation and controls the drive of the polygon motor 1064 based on the rotation duration stored in the auxiliary storage device 124. As a result, the polygon motor 1064 is driven for a certain period of time (ACT 31).

For example, if the first execution frequency is selected, the printer processor 1271 drives the polygon motor 1064 based on the first rotation duration associated with the first execution frequency. As a result, the polygon motor 1064 continues to drive the rotation. If the printer processor 1271 does not detect the elapse of the first rotation duration (ACT 34, NO) without receiving a printing instruction (ACT 32, NO), the polygon motor 1064 is driven as is.

If the printer processor 1271 detects the elapse of the first rotation duration (ACT 34, YES) without receiving a printing instruction (ACT 32, NO), the printer processor 1271 instructs the polygon motor 1064 to stop driving. As a result, the polygon motor 1064 stops driving (ACT 35). When receiving a printing instruction (ACT 32, YES), the printer processor 1271 executes image formation (ACT 2).

Similarly, if the second execution frequency is selected, the printer processor 1271 drives the polygon motor 1064 based on the second rotation duration associated with the second execution frequency. If the third execution frequency is selected, the printer processor 1271 drives the polygon motor 1064 based on the third rotation duration associated with the third execution frequency. If the fourth execution frequency is selected, the printer processor 1271 drives the polygon motor 1064 based on the fourth rotation duration associated with the fourth execution frequency.

Figure 10:
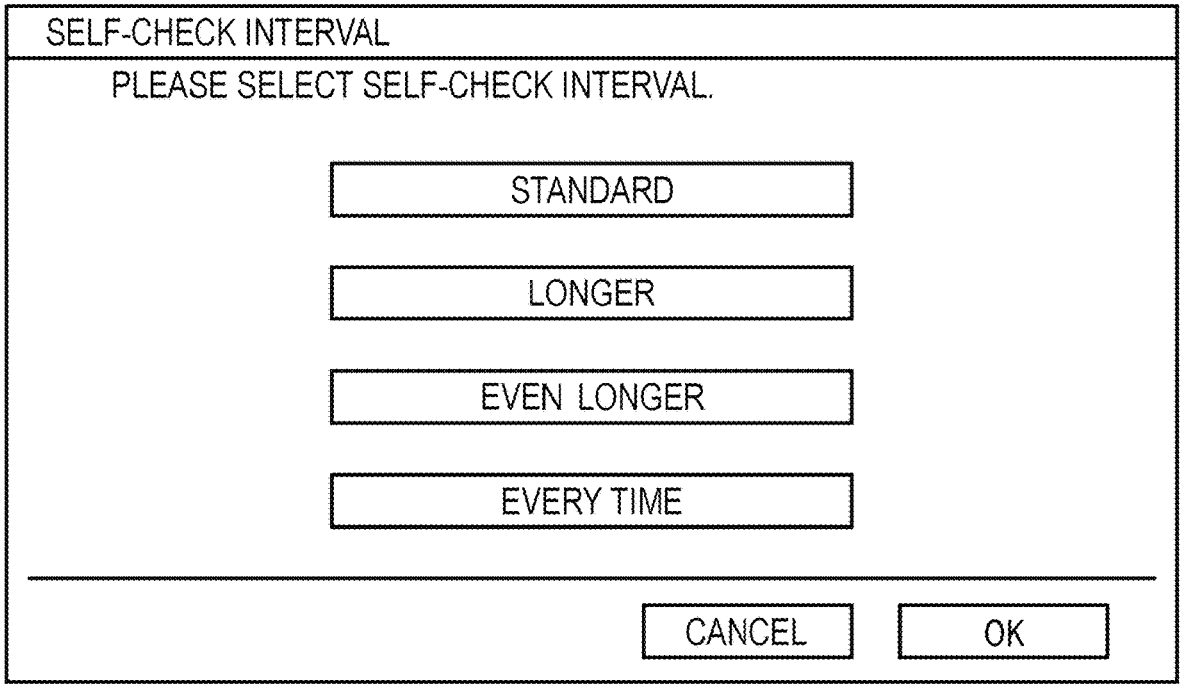
FIG. 10 illustrates a view of an example of a menu for changing an execution frequency of an image quality self-check displayed by the image forming apparatus.

FIG. 10 illustrates a view of an example of a menu for changing the execution frequency of the image quality self-check displayed by the image forming apparatus 100 according to at least one embodiment.

The control panel 116 displays a menu for changing the execution frequency of the image quality self-check in response to an input operation from the user. For example, the change menu includes items such as "standard", "longer", "even longer", and "every time after printing". The execution frequency decreases in the order of "standard", "longer", and "even longer".

Figure 11:
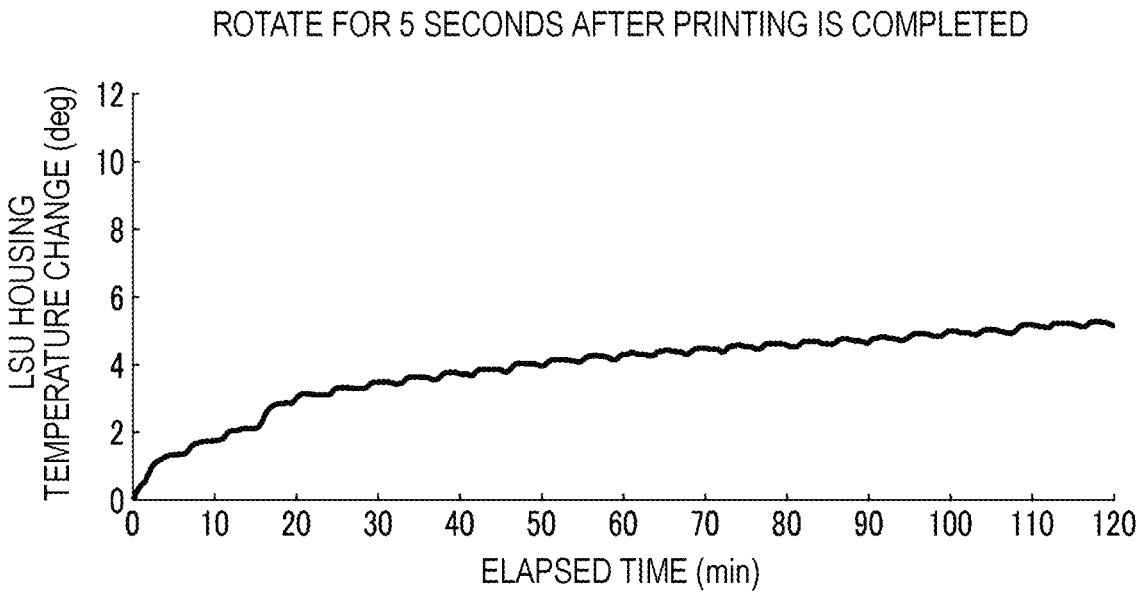
FIG. 11 illustrates a view of a first example of a temperature change inside a housing of the optical scanning device of the image forming apparatus.

FIG. 11 illustrates a view of a first example of a temperature change inside the housing 1061 of the optical scanning device 106 of the image forming apparatus 100 according to at least one embodiment. For example, if the image forming apparatus 100 executes printing for about 1 minute every 4 minutes and further rotates the polygon motor 1064 for 5 seconds after printing, the temperature changes as illustrated in FIG. 11.

Figure 12:
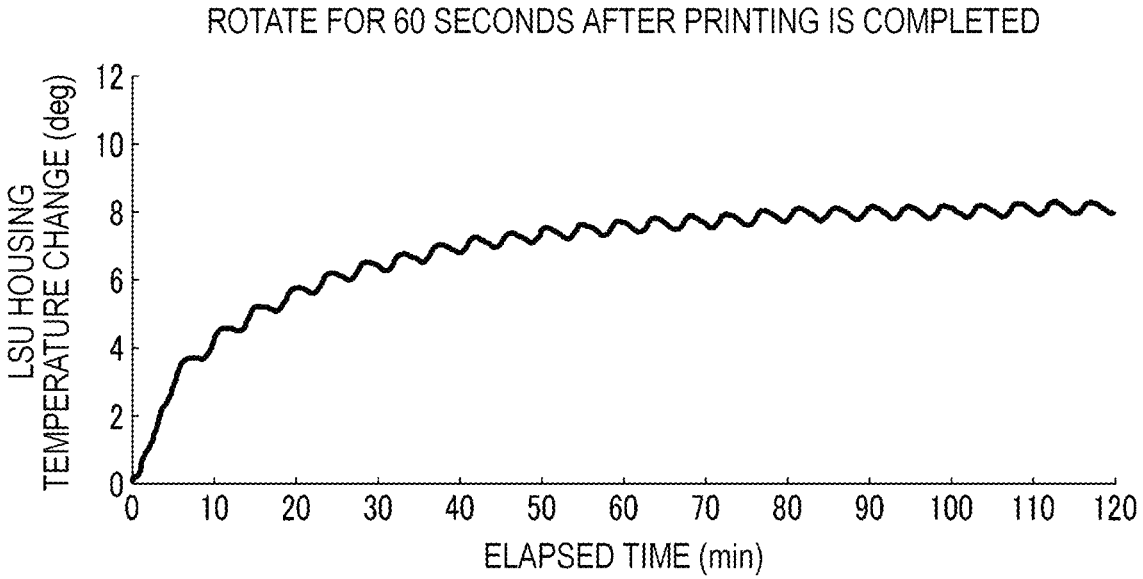
FIG. 12 illustrates a view of a second example of a temperature change inside the housing of the optical scanning device of the image forming apparatus.

FIG. 12 illustrates a view of a second example of a temperature change inside the housing 1061 of the optical scanning device (scanner) 106 of the image forming apparatus 100 according to at least one embodiment. For example, if the image forming apparatus 100 executes printing for about 1 minute every 4 minutes and further rotates the polygon motor 1064 for 60 seconds after printing, the temperature changes as illustrated in FIG. 12.

For example, assuming that the first rotation duration is 60 seconds and the second or third rotation duration is 5 seconds, it can be seen that the temperature rise inside the housing 1061 due to the heat generated by the polygon motor 1064 is suppressed. As described above, the printer processor 1271 of the image forming apparatus 100 changes the rotation duration of the polygon motor 1064 during the standby operation based on the change in the execution frequency of the image quality self-check. That is, the printer processor 1271 shortens the rotation duration of the polygon motor 1064 during standby operation in response to a change input for increasing the interval of the execution frequency of the image quality self-check (for example, change input from the first execution frequency to the second execution frequency). As a result, since the temperature rise inside the housing 1061 is suppressed, it is possible to prevent or reduce the deterioration of the image quality if the execution frequency of the image quality self-check is reduced.

Further, the printer processor 1271 may change the rotation duration of the polygon motor 1064 during the standby operation and change the temperature threshold based on the change in the execution frequency of the image quality self-check. For example, the printer processor 1271 shortens the rotation duration of the polygon motor 1064 during the standby operation (for example, change from the first rotation duration to the second rotation duration) in response to a change input for increasing the interval of the execution frequency of the image quality self-check (for example, change input from the first execution frequency to the second execution frequency) and further raises the temperature threshold (for example, change the first temperature threshold to the second temperature threshold). As a result, it is possible to suppress the temperature rise inside the housing 1061 and prevent the deterioration of the image quality while sufficiently reducing the execution frequency of the image quality self-check according to the intention of the user.

Further, since the image forming apparatus 100 of at least one embodiment displays a menu for changing the execution frequency of the image quality self-check illustrated in FIG. 10, the user can easily change the execution frequency from this change menu. Further, the image forming apparatus 100 may display a change menu for selecting the image quality instead of the change menu for selecting an image quality self-check interval illustrated in FIG. 10. For example, the change menu for selecting the image quality includes "high quality" (e.g., first execution frequency), "standard image quality" (e.g., second execution frequency), "monochrome" (e.g., third execution frequency), and "maximum image quality" (e.g., fourth execution frequency), and the user can select the execution frequency of the image quality self-check from the viewpoint of image quality.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a scanner configured to emit a laser beam reflected by a polygon mirror, the polygon mirror rotated by a polygon motor;

an image forming unit configured to form an image based on a latent image carried on a photoconductor by the laser beam;

a memory configured to store an execution frequency of an image quality self-check of the image formed by the image forming unit and a rotation duration of the polygon motor during a standby operation period of image formation; and a processor configured to accept a change in the execution frequency;

cause a change in the rotation duration based on the change in the execution frequency;

execute the image quality self-check based on the execution frequency; and continuously rotate the polygon motor during the standby operation period based on the rotation duration stored.

2. The apparatus of claim 1, wherein the image quality self-check includes a check for image misalignment affected by a temperature change due to heat generation of the polygon motor.

3. The apparatus of claim 2, wherein the processor is configured to:

form a patch for measuring misalignment of an image with a plurality of colors;

measure the patch; and detect a misalignment amount of the patch to correct the image misalignment of the image with the plurality of colors based on the misalignment amount.

4. The apparatus of claim 1, wherein the execution frequency is a frequency based on an elapsed time from last execution of the image quality self-check, and when determining that the image quality self-check needs to be executed based on the execution frequency and the elapsed time, the processor executes the image quality self-check.

5. The apparatus of claim 4, wherein the processor is configured to change from a first rotation duration to a second rotation duration shorter than the first rotation duration based on a change from a first execution frequency to a second execution frequency lower than the first execution frequency.

6. The apparatus of claim 1, wherein the execution frequency is a frequency based on an acquisition interval of a temperature measurement value of the optical scanning device, and when determining that the image quality self-check needs to be executed based on comparison between the temperature measurement value and a temperature threshold stored in the memory, the processor causes the image quality self-check to be executed.

7. The apparatus of claim 6, wherein the processor is configured to change from a first rotation duration to a second rotation duration shorter than the first rotation duration based on a change from a first execution frequency to a second execution frequency lower than the first execution frequency.

8. The apparatus of claim 6, wherein the processor is configured to change the temperature threshold based on a change in the execution frequency.

9. The apparatus of claim 6, wherein the processor is configured to change a first temperature threshold to a second temperature threshold higher than the first temperature threshold based on a change from a first execution frequency to a second execution frequency lower than the first execution frequency.

10. The apparatus of claim 1, wherein the processor is configured to execute a standby operation if an image is formed and there is no next image formation.

11. A method of operating an image forming apparatus, the method comprising:

emitting a laser beam reflected by a polygon mirror, the polygon mirror rotated by a polygon motor;

forming an image based on a latent image carried on a photoconductor by the laser beam;

storing an execution frequency of an image quality self-check of the image formed and a rotation duration of the polygon motor during a standby operation period of image formation;

accepting a change in the execution frequency;

changing the rotation duration based on the change in the execution frequency;

executing the image quality self-check based on the execution frequency; and continuously rotating the polygon motor during the standby operation period based on the rotation duration stored.

12. The method of claim 11, wherein the image quality self-check includes checking for image misalignment affected by a temperature change due to heat generation of the polygon motor.

13. The method of claim 12, further comprising:

forming a patch for measuring misalignment of an image with a plurality of colors;

measuring the patch; and detecting a misalignment amount of the patch to correct the image misalignment of the image with the plurality of colors based on the misalignment amount.

14. The method of claim 11, wherein the execution frequency is a frequency based on an elapsed time from last execution of the image quality self-check, and the method further comprises executing the image quality self-check when determining that the image quality self-check is to be executed based on the execution frequency and the elapsed time.

15. The method of claim 14, further comprising changing from a first rotation duration to a second rotation duration shorter than the first rotation duration based on a change from a first execution frequency to a second execution frequency lower than the first execution frequency.

16. The method of claim 11, wherein the execution frequency is a frequency based on an acquisition interval of a temperature measurement value of the optical scanning device, and the method further comprises causing the image quality self-check to be executed when determining that the image quality self-check is to be executed based on comparison between the temperature measurement value and a temperature threshold stored in the memory.

17. The method of claim 16, further comprising changing from a first rotation duration to a second rotation duration shorter than the first rotation duration based on a change from a first execution frequency to a second execution frequency lower than the first execution frequency.

18. The method of claim 16, further comprising changing the temperature threshold based on a change in the execution frequency.

19. The method of claim 16, further comprising changing a first temperature threshold to a second temperature threshold higher than the first temperature threshold based on a change from a first execution frequency to a second execution frequency lower than the first execution frequency.

20. The method of claim 11, further comprising executing a standby operation if an image is formed and there is no next image formation.

* * * * *